United States Patent [19]

Phillips

[11] 4,030,556

[45] June 21, 1977

[54] MINIATURE IMPACT TOOL

[76] Inventor: Raymond J. Phillips, 879 Raymond Hill Road, Oakdale, Conn. 06370

[22] Filed: Sept. 22, 1975

[21] Appl. No.: 615,453

[52] U.S. Cl. ..... 173/120; 173/123; 173/139

[51] Int. Cl.[2] ..... B25D 1/00

[58] Field of Search ..... 173/120, 123, 139, 116, 173/118, 48, 119, 122

[56] References Cited

UNITED STATES PATENTS

| | | | |
|---|---|---|---|
| 2,220,195 | 11/1940 | Amundsen | 173/120 X |
| 2,298,845 | 10/1942 | Schmied | 173/120 |
| 2,501,542 | 3/1950 | Sheldon | 173/120 |
| 2,635,854 | 4/1953 | Richards et al. | 173/139 X |
| 2,905,034 | 9/1959 | Turner | 173/120 X |
| 3,022,838 | 2/1962 | Mitchell | 173/120 |
| 3,074,155 | 1/1963 | Cootes et al. | 173/120 |
| 3,874,460 | 4/1975 | Schmid et al. | 173/48 X |

FOREIGN PATENTS OR APPLICATIONS

| | | | |
|---|---|---|---|
| 183,403 | 3/1922 | United Kingdom | 173/120 |

*Primary Examiner*—Ernest R. Purser
*Assistant Examiner*—William F. Pate, III
*Attorney, Agent, or Firm*—Richard S. Sciascia; Arthur A. McGill; Prithvi C. Lall

[57] ABSTRACT

A miniature impact tool utilizes a cam for driving a striker forward by converting a rotary motion to a linear motion. The striker is spring loaded and is moved away from a surface to be struck during a portion of the rotation cycle of the cam. On further rotation the cam surface is cut away and spring action drives the striker forward causing impact. The above action is then repeated. The tool is adapted to be provided with variable drive speed and torque.

6 Claims, 4 Drawing Figures

MINIATURE IMPACT TOOL

STATEMENT OF GOVERNMENT INTEREST

The invention described herein maybe manufactured and used by or for the Government of the United States of America for governmental purposes without the payment of any royalties thereon or therefore.

BACKGROUND OF THE INVENTION

The present invention generally relates to an impact tool and more particularly to a hand-held mechanically operated impact tool for use in engraving, gem-setting, carving, riveting, peening, chipping, diemaking, dental and orthopedic surgery, sculpting, etc. The inventive impact tool is easier to use than the conventional tool and hammer method in that the inventive device requires less skill, causes less chock disturbance, gives greater accuracy, is easier to control and increases productivity. The design allows the device to be contained in a small package. This enables accurate control by one hand, leaving the other hand free to hold and position the workpiece.

The present methods of engraving, gem setting, bone surgery, carving of hard materials, light riveting, delicate chipping, block cutting, and some tool and die work mostly requires the use of two hands. One hand holds and positions the tool while the other hand wields the hammer. In most cases this technique requires a highly skilled artisan. In addition, in many instances a method for holding and/or positioning the workpiece is needed. While doing the task in this manner, an inadvertant slip of the tool or an inaccurate hammer blow can damage or alter the desired effect.

SUMMARY OF THE INVENTION

It is therefore a general object and purpose of the present invention to provide an improved impact device. It is a further object that the device be a hand held mechanically operated impact tool. Additional objects are that the device be compact, lightweight, efficient, economical and require less skill to operate than previous devices performing similar functions. These and other objects of the invention and the various features and details of construction and operation will become apparent from the specification and drawings.

This is accomplished in accordance with the present invention by providing a device which converts rotary motion to linear motion. The apparatus comprises a first unit adapted to be driven in a rotational manner. The first unit drives a second unit in a lineal direction by means of a cam interface. The second unit connects directly to the cutting tool. The apparatus in addition comprises a plurality of bearing surfaces to ease the friction associated with the rotary motion. A spring and plunger arrangement are used to provide the force necessary for the linear motion. The entire device weighs approximately six ounces.

DESCRIPTION OF THE PREFERRED EMBODIMENT

Figure 1:
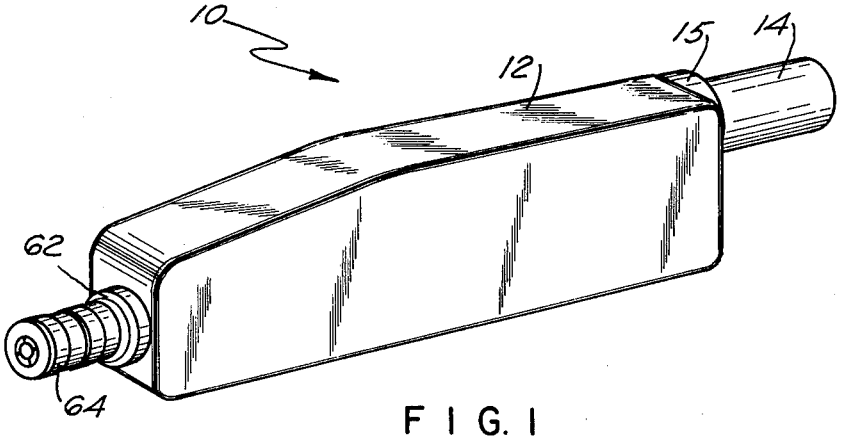
FIG. 1 is a pictorial representation of the present invention.

Referring now to FIG. 1 there is shown generally a miniature impact tool 10. A housing 12 has at its aft end a drive shaft retainer 14 having a flange 15. At the fore end of tool 10 is shown a threaded retainer 62 that holds a sleeve 64.

Figure 2:
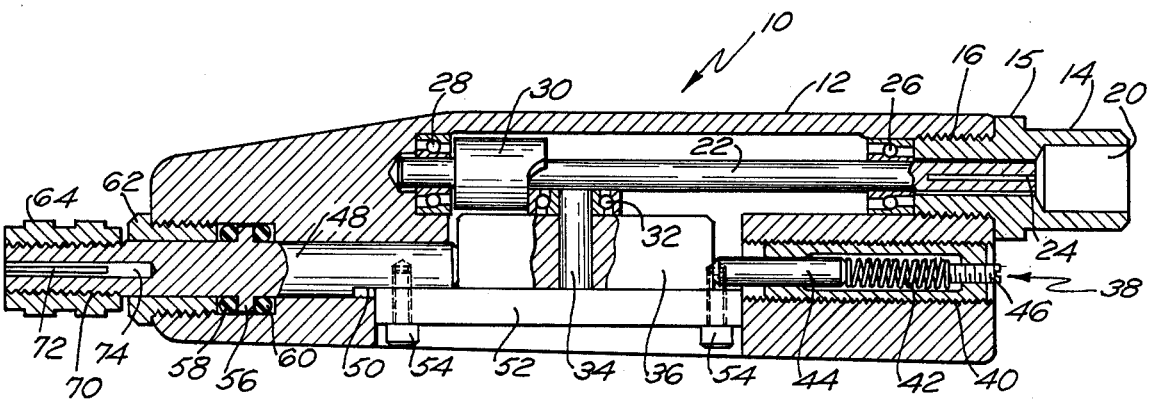
FIG. 2 is a cutaway side view of the apparatus of FIG. 1.

FIG. 2 is a cutaway view showing the invention in more detail. The retainer 14 is shown having threads 16 for securing to housing 12. An aperture 20 is adapted for holding a rotary drive (not shown) which is secured to a shaft 22 with a slot 24 for mating with the rotary drive. Ball bearing assemblies 26 and 28 are disposed between shaft 22 and the interior wall of housing 12. A cam 30 is affixed to shaft 22. A bearing assembly 32 functions as a cam follower and is affixed to a pin 34. A press fit secures the pin 34 to a striker 36. Aft of the striker 34 is a spring plunger assembly 38. Assembly 38 comprises a body 40 that is screwed into a portion of housing 12. A spring 42 and plunger 44 are confined by body 40. A spring retainer screw 46 adjusts the tension of spring 42. A cylindrical toolholder 48 has a cutaway flattened portion 50 for abutting bottom plate 52 in order to prevent the rotation of toolholder 48. A plate 52 has a plurality of socket head screws 54 for affixing the plate 52 to housing 12. The toolholder 48 has a circular flange 56 secured to toolholder 48. A pair of 0 rings 58, 60 abut the sides of flange 56. A threaded retainer 62 holds 0 rings 58, 60 and shaft 48 in place. The toolholder has in addition, jaws 70 that surround an aperture 72 forming slots 74. A sleeve 64 is threaded to the end of toolholder 48.

Figure 3:
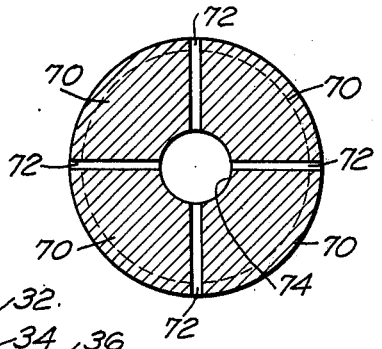
FIG. 3 is an end view of a portion of the inventive apparatus of FIG. 1.
Figure 4:
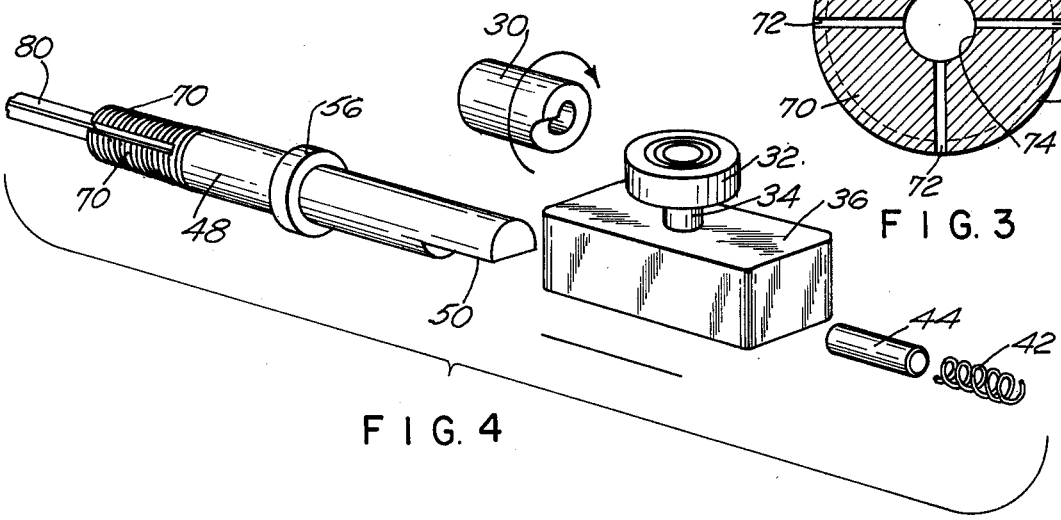
FIG. 4 is an exploded view of several of the components of FIG. 2.

FIG. 3 shows an end view of toolholder 48. The arrangement of jaws 70, aperture 72 and slots 74 is shown. FIG. 4 shows an exploded view of several components to assist in understanding the following operational description of the device.

In operation a rotary drive unit is affixed to shaft 22 through aperture 20 causing cam 30 to rotate. The rotation of cam 30 places a force against bearing 32 and pin 34 causing striker 36 to retract against plunger 44. This in turn compresses spring 42. On bearing 32 riding beyond the raised portion of cam 30 the force against bearing 32 is released thereby causing spring 42 to move plunger 44 and striker 36 forward. Striker 36 then hits toolholder 48 a sharp blow. The above cycle is then repeated.

There has therefore been described a miniature impact tool suitable to be hand held for various applications. The tool converts a rotary to a linear motion through the use of a cam acting on a spring loaded device.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A miniature impact tool comprising:

rotary means adapted for being driven in a rotary motion;

linear reciprocating means abutting said rotary means for converting the rotary motion to a linear motion, said linear reciprocating shock including a toolholder, said toolholder including a cylindrical flange located on an intermediate portion of said toolholder, said toolholder including a body that is cylindrically shaped for a predetermined axial distance on one side of said cylindrical flange, the end of said one side of said toolholder away from said cylindrical flange having a segment of circle cross-sectional area forming a flat area in the axial direction extending from said cylindrical shape, the other side of said cylindrical flange being cylindrically shaped and having threading and an aperture arrangement adapted to hold a tool at the end of said other side away from said cylindrical flange;

a threaded sleeve connected to said toolholder threading;

a housing enclosing said rotating means and a substantial portion of said linear reciprocating means, said housing including a housing aperture, said housing aperture having an outer section enclosing a portion of said toolholder including said flange and being of a diameter larger than the diameter of said toolholder flange and said housing aperture having an inner section enclosing a portion of said toolholder and being of a diameter smaller than said toolholder flange; and retaining means for retaining said toolholder including 0 rings encircling and abutting a portion of said toolholder positioned on both sides of said toolholder flange, and a retainer having an aperture for insertion of said toolholder, said retainer inserted in the outer portion of said housing aperture and connected to said housing, said retainer located for abutting one of said 0 rings.

2. A miniature impact tool according to claim 1 wherein said housing further comprises a removable plate abutting the flat area of the segment of circle portion of said toolholder.

3. A miniature impact tool according to claim 2 wherein said rotary means further comprises:

a member adapted to be driven in a rotary motion; and a cam connected to said member.

4. A miniature impact tool according to claim 3 wherein said linear reciprocating means further comprises:

a cam follower abutting said cam;

a striker connected to said cam follower, said striker on one end abutting said toolholder; and a spring plunger assembly abutting the other end of said striker.

5. A miniature impact tool according to claim 4 wherein said spring plunger assembly further comprises:

a hollow cylindrical body positioned within said housing;

a plunger positioned within said body having one end in abutment with said other end of said striker;

a spring in abutment with said plunger; and a spring retainer screw in abutment with said spring for adjusting spring tension.

6. A miniature impact tool according to claim 5 wherein said cam follower further comprises;

a bearing assembly abutting said cam; and a pin connecting said bearing assembly and said striker.

* * * * *